US005133620A

United States Patent [19]

Scheiwiller

[11] Patent Number: 5,133,620

[45] Date of Patent: Jul. 28, 1992

[54] INTERCONNECTING PAVING STONES

[76] Inventor: Rolf Scheiwiller, Buolterlistrasse 9, CH-6052 Hergiswil, Switzerland

[21] Appl. No.: 602,651

[22] Filed: Oct. 24, 1990

[30] Foreign Application Priority Data

Oct. 24, 1989 [EP] European Pat. Off. ..... 89810800

[51] Int. Cl.[5] ..... E01C 5/00

[52] U.S. Cl. ..... 404/37; 404/41

[58] Field of Search ..... 404/37, 38, 39, 40, 404/41, 42; 52/603, 604, 605

[56] References Cited

U.S. PATENT DOCUMENTS

| | | | |
|---|---|---|---|
| D. 256,817 | 9/1980 | Allard . | |
| 3,873,225 | 3/1975 | Jakobsen et al. . | |
| 4,052,131 | 10/1977 | Lowrigkeit | 404/38 X |
| 4,922,678 | 5/1990 | Scheiwiller | 52/604 X |

FOREIGN PATENT DOCUMENTS

| | | | |
|---|---|---|---|
| 0016353 | 10/1980 | European Pat. Off. . | |
| 1957328 | 3/1967 | Fed. Rep. of Germany . | |
| 1988250 | 3/1968 | Fed. Rep. of Germany . | |
| 2122994 | 11/1972 | Fed. Rep. of Germany . | |
| 2743317 | 4/1979 | Fed. Rep. of Germany . | |
| 2917713 | 11/1980 | Fed. Rep. of Germany . | |
| 8302622 | 6/1983 | Fed. Rep. of Germany . | |
| 8606104 | 6/1986 | Fed. Rep. of Germany . | |
| 8901920 | 7/1989 | Fed. Rep. of Germany . | |
| 2277936 | 4/1975 | France . | |
| 277457 | 9/1930 | Italy | 404/38 |
| 370880 | 5/1939 | Italy | 404/41 |
| 1386088 | 3/1975 | United Kingdom . | |
| 1565504 | 4/1980 | United Kingdom | gbx/ |

OTHER PUBLICATIONS

World Intellectual Property Organization Document DMA/000865.

*Primary Examiner*—William P. Neuder

*Attorney, Agent, or Firm*—Marks & Murase

[57] ABSTRACT

The interconnecting paving stones are provided on at least two opposing sides with outwardly tapering teeth. On one side of said stones, the front sides of said teeth are provided with indentation keys, and on the other side, with indentation grooves. Moreover, the flanks of one row of teeth comprise spacing bosses. An interconnecting paving stone can have the configuration of a rectangular stone and can comprise three teeth on each of its longitudinal sides and either a projection or a recess on the narrow sides.

The interconnecting paving stones can be used either for the construction of bicycle lanes with increased smoothness, in which case said teeth engage with each other, or as interconnecting lawn stones, where respective teeth adjoin and interlock by means of said indentation keys and grooves.

19 Claims, 5 Drawing Sheets

INTERCONNECTING PAVING STONES

BACKGROUND OF THE INVENTION

The present invention relates to interconnecting stones having such a configuration that they can be used both as paving stones for bicycle lanes and as interconnecting stones for lawns. There is a wide range of known interconnecting stones with possible applications for walkways or driveways, as well as interconnecting lawn stones providing a maximum surface for the lawn while being sufficiently interconnected in order to remain in place when used by vehicles.

From the German Utility Model No. 1,988,250 is known an interconnecting paving stone with teeth which reach into the openings between said teeth, however without any indentations or spacing means.

The German Utility Model No. 1,957,328 discloses a concrete lawn stone with indentation means at the end of the teeth, said teeth however being rectangular and having no spacing means.

SUMMARY OF THE INVENTION

On this background, it is the object of the invention to provide interconnecting stones for multiple use, such as both for the construction of bicycle lanes, where maximum smoothness is desired, and as interconnecting lawn stones. This object is attained by means of interconnecting stones wherein said stones comprise outwardly tapering teeth, the front sides of said teeth being provided with indentation keys on one side of said stones, and the front sides of said teeth on the other side being provided with corresponding indentation grooves, and that at least one of the two flanks of said teeth is provided with a spacing boss.

SHORT DESCRIPTION OF THE DRAWINGS

Hereinafter, the invention is further explained by means of a drawing of exemplifying embodiments.

DETAILED DESCRIPTION OF THE DRAWING

Figure 1:
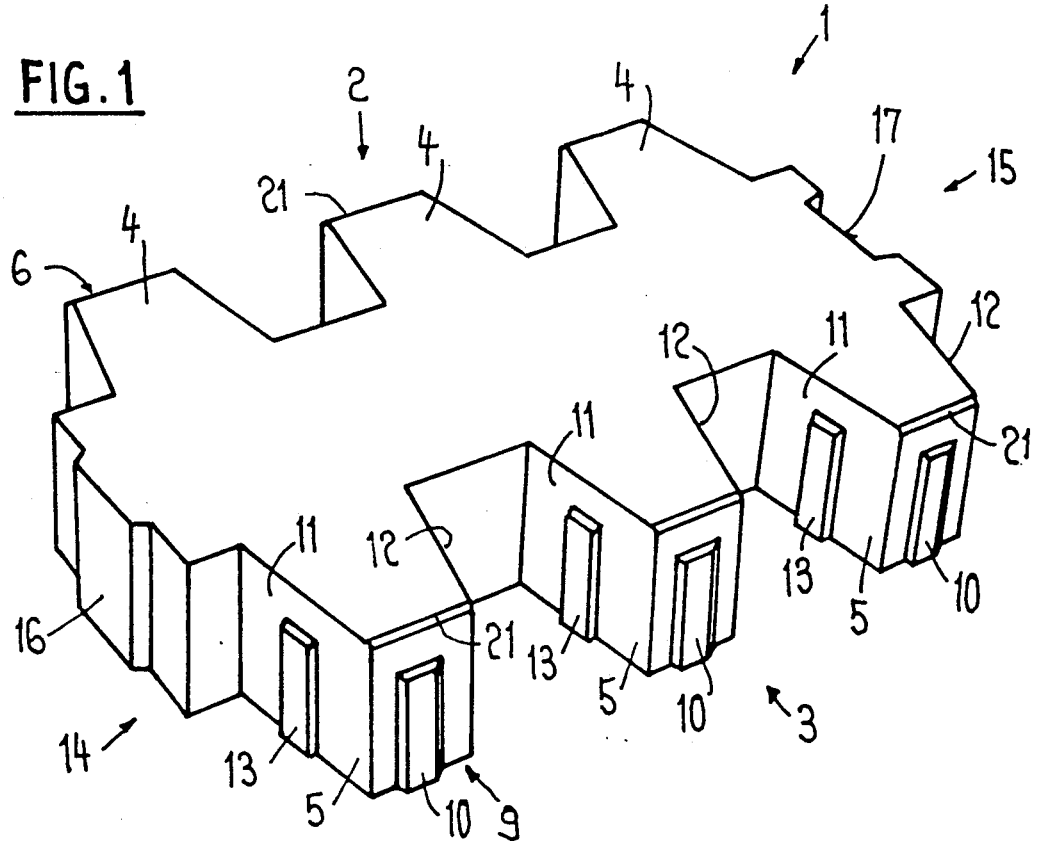
FIGS. 1 and 2 show perspective views of a first embodiment in the form of a rectangular stone as seen in two respective positions when turned by 180°.
Figure 2:
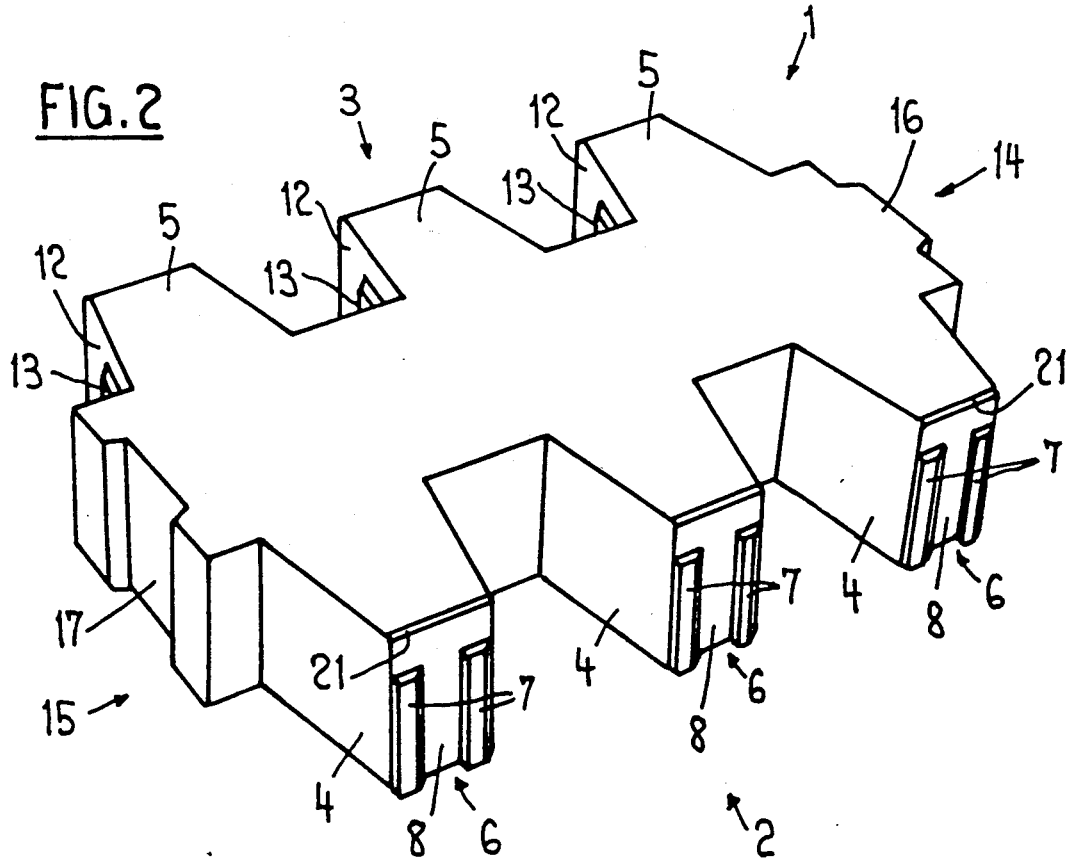

FIGS. 1 and 2 illustrate a first stone, namely rectangular stone 1, which is provided with three teeth 4 and 5 on each of its longitudinal sides 2 and 3. On their front sides 6, the teeth 4 of one row are provided with two respective projections 7 which form between them an indentation groove while the front sides 9 of the other row of teeth 5 each comprise a corresponding indentation key 10. As appears clearly in FIGS. 1 and 2, the teeth 4 and 5 are tapered towards the outside, and the width of the complementary recesses formed by the flanks of said teeth increases accordingly. In the present example, both flanks 11 and 12 of the row of teeth 5 comprise a spacing boss 13. Instead of providing these bosses on one side only, they might be provided on the teeth of both sides, however on one respective tooth flank only. FIGS. 1 and 2 further illustrate that both the projections 7 and the indentation keys 10 as well as the spacing bosses 13 start from the bottom but do not extend over the full height of the interconnecting stone, such that these parts are invisible when the stones are laid out and the joints are filled with sand.

In order to obtain full interconnection of these stones, the narrow sides 14 and 15 are also provided with indentation means, the narrow side 14 comprising a projection 16, and the narrow side 15 comprising a recess 17 corresponding to said projection.

Figure 3:
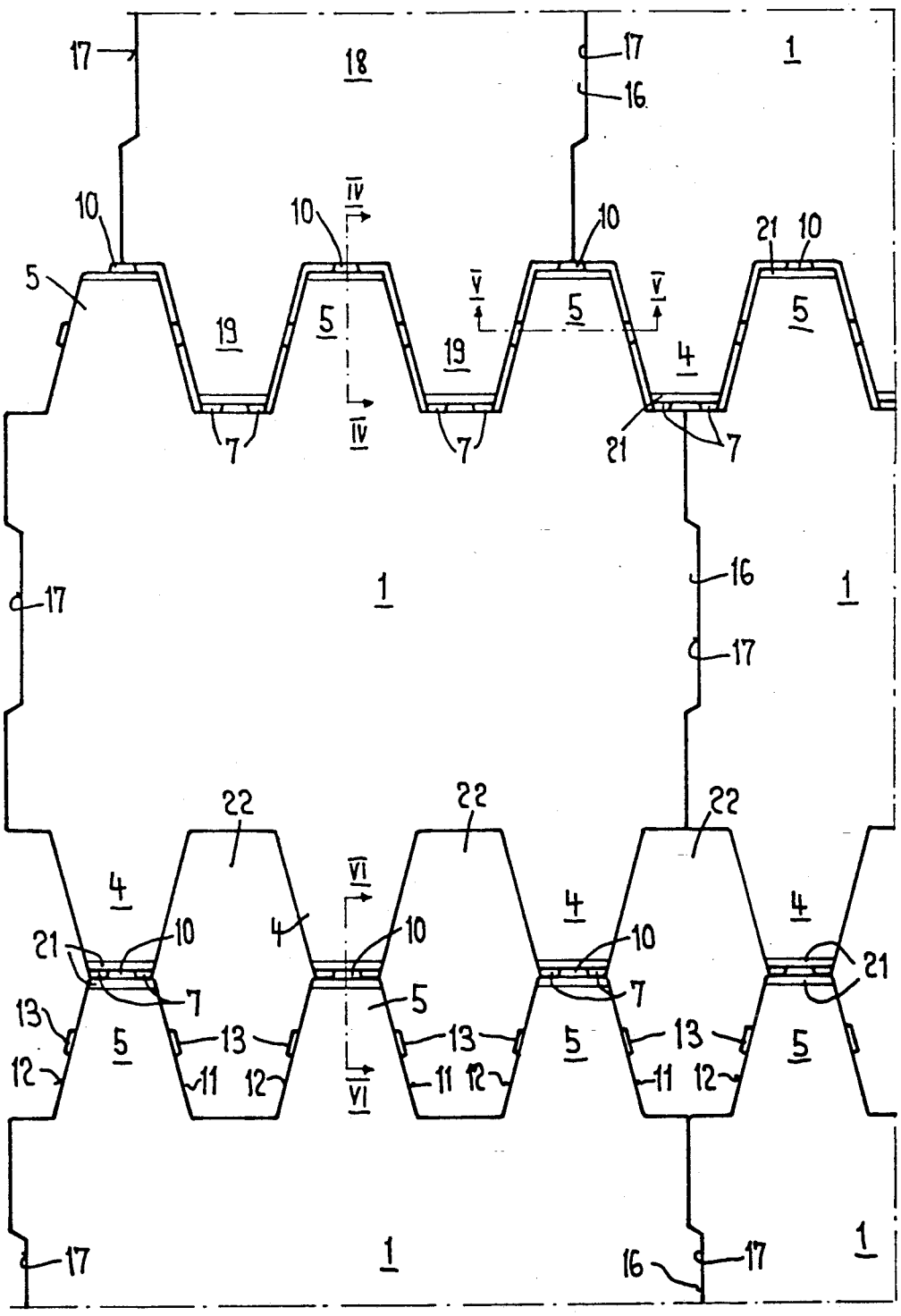
FIG. 3 shows a stone according to FIG. 1 or 2 with adjoining stones in a layout.
Figure 7:
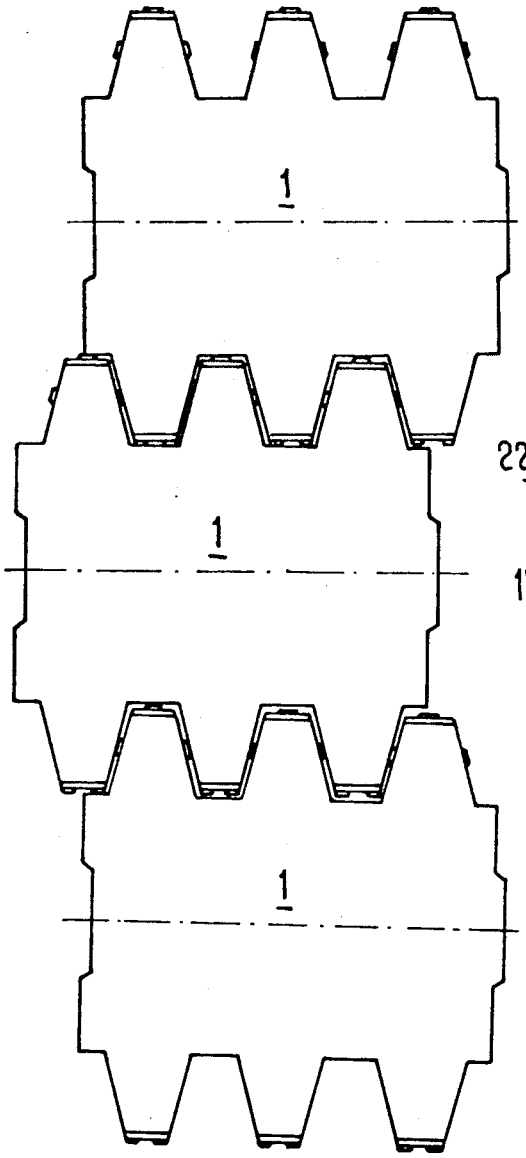
FIG. 7 shows three interconnecting stones which are not quite laid out in a straight line, in order to form a slight curve.
Figure 8:
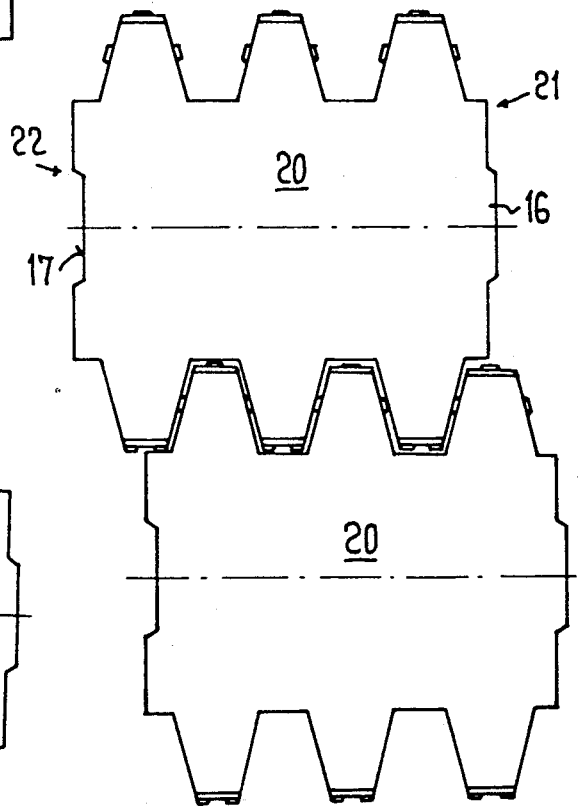
FIG. 8 shows an alternative embodiment of the interconnecting stone according to FIG. 1.
Figure 9:
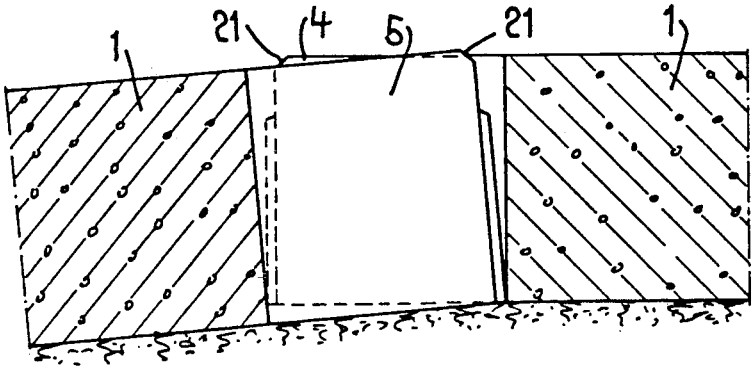
FIG. 9 shows a section of two stones which are laid out on an uneven surface.

A part of FIG. 3 as well as FIGS. 7 through 9 illustrate how such rectangular stones are laid out to form an interconnecting structure, e.g. for the construction of a bicycle lane. FIG. 3 shows the rectangular stone 1 as described above with an adjacent further rectangular stone 1, which is not fully represented in the drawing (top right), and on the upper left of FIG. 3, another rectangular stone 18 which comprises only two teeth 19 on each of the opposing sides as well as projection 16 and recess 17. In this interconnecting layout, the indentation grooves and keys serve the same purpose as the spacing bosses, namely to prevent that the teeth become wedged, and to ensure a regular joint pattern. On the base of the two rectangular stones 1 and 18, it is of course conceivable to provide rectangular stones having a greater number of teeth or, for special purposes, only one tooth on each side.

Figure 4:
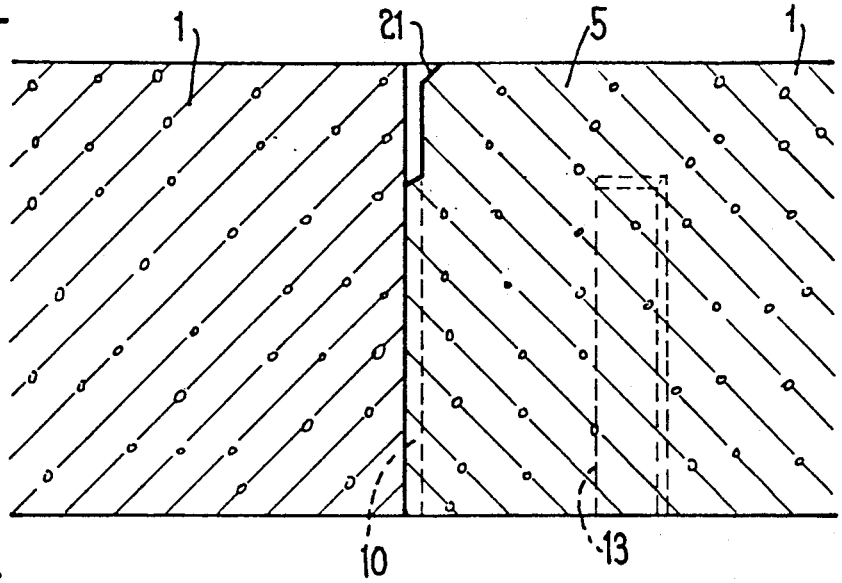
FIG. 4 shows a section according to line IV—IV in FIG. 3.
Figure 5:
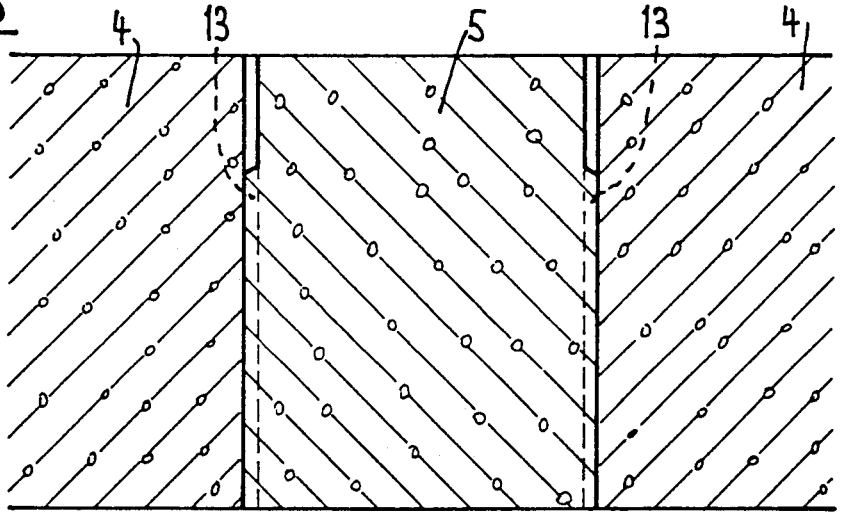
FIG. 5 shows a section according to line V—V in FIG. 3.
Figure 6:
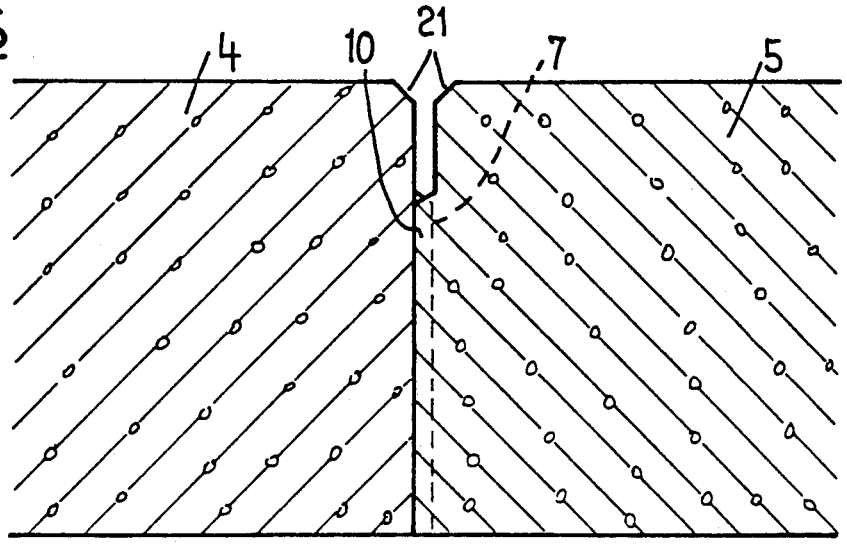
FIG. 6 shows a section according to line VI—VI in FIG. 3.

FIG. 7 illustrates the possibility of producing a curve, which need not be very sharp in the case of bicycle lanes, by a slight canting of the stones. According to an alternative embodiment, FIG. 8 shows two stones 20 which, for the same purpose, are not exactly rectangular but slightly trapezoidal, their longitudinal sides being slightly convergent instead of being strictly parallel, and the narrow side 21 provided with projection 16 being somewhat larger than the narrow side 22 provided with recess 17. Otherwise, stone 20 has the same configuration as stone 1, but its conical shape allows the construction of curves. In order to smooth the joints between the individual stones, their edges, in particular those of the tooth front sides, are chamfered as shown in FIGS. 4, 5 and especially 9.

Figure 10:
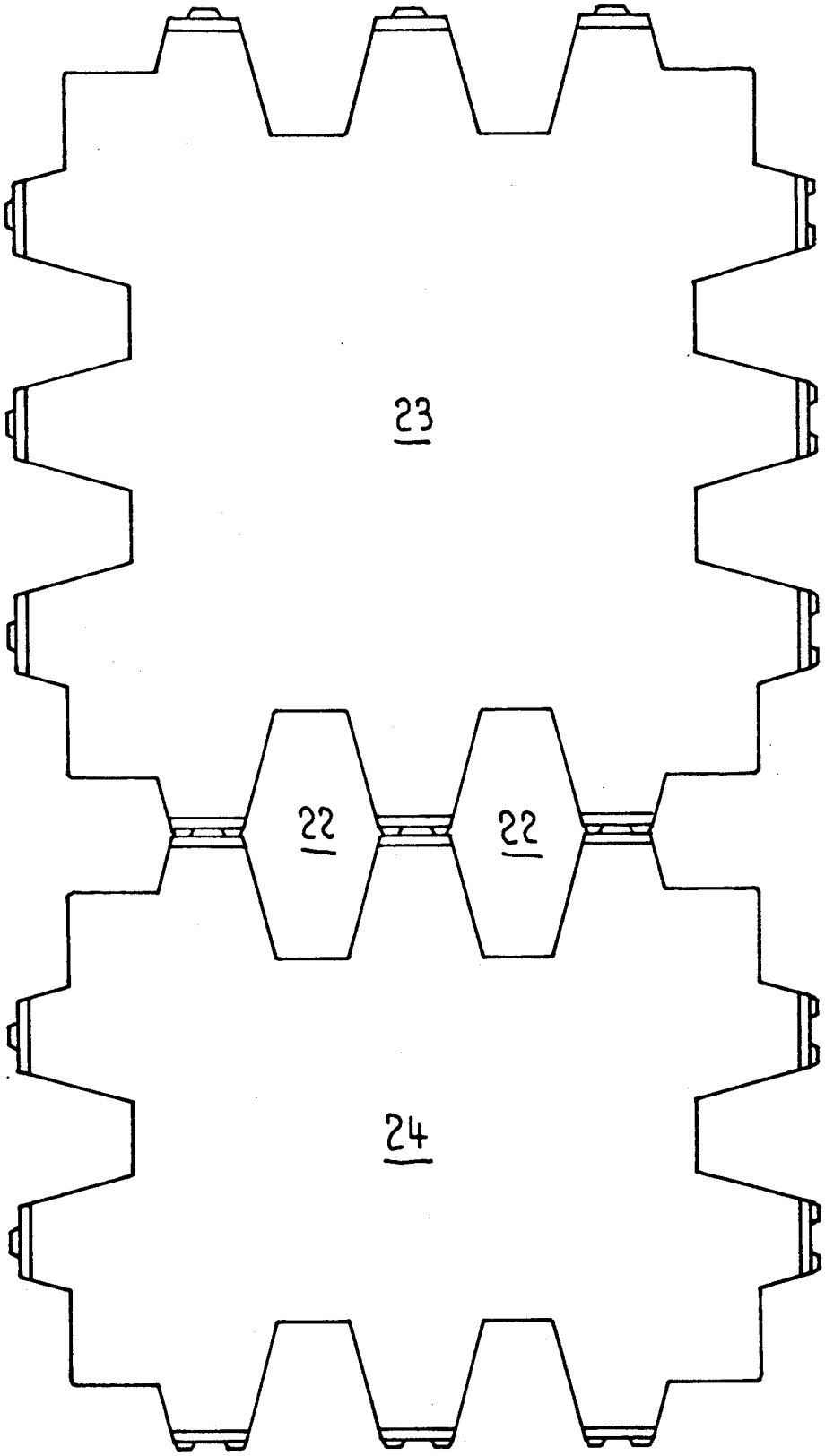
FIG. 10 shows a further embodiment in the form of a square interconnecting stone used as a lawn stone in conjunction with an interconnecting stone according to the first embodiment.

The lower part of FIG. 3 as well as FIG. 10 illustrate a second utilization of the interconnecting stones as lawn stones. For this purpose, only the front sides of their teeth are in contact, and openings 22 are formed therebetween which may be filled with earth and planted with grass. In this case, the interconnection is effected by means of indentation grooves and indentation keys 10 on the front sides of the teeth, as well as by projections 16 and recesses 17 on the narrow sides of the stones.

Another embodiment in the form of a square stone 23 is illustrated in FIG. 10, said stone comprising three teeth with indentation keys and grooves and spacing bosses on each of its four sides. FIG. 10 illustrates a further embodiment in the form of a rectangular interconnecting stone 24 which comprises two teeth 4 and 5 on its narrow sides, said teeth being provided with the same indentation grooves and keys and the same spacing bosses as those of stone 1.

In practical use of the above-described interconnecting stones, openings may be provided at suitable locations of the stones in order to increase the plantable proportion thereof. If required, the openings intended for planting may alternatively be used for filling stones e.g. of a different color, for marking purposes or the like. Moreover, both the filling stones and the interconnecting stones may have a surface structure such as longitudinal or transversal grooves.

The above-mentioned filling stones can be used e.g. as markings on bicycle lanes. In this case, in order to signal intersections or the like, the interconnecting stones may be laid out like lawn stones, i.e. with adjoining front sides, and differently colored and/or slightly convex filling stones may be inserted into the resulting openings for increased attention.

What I claim is:

1. A paving stone comprising a base with first and second oppositely positioned sides, a first set of tapered outwardly extending teeth on said base's first side, each tooth of said first set being provided with an end distant from said base and an indentation key on said end, and a second set of outwardly extending teeth on said base's second side, each tooth of said second set being provided with an end distant from and two flanks adjacent to said base, with at least one of said flanks having a spacing boss on said flank, and said teeth in said second set having projections on their ends which form an indentation groove corresponding in shape to said indentation keys.

2. A paving stone as in claim 1, wherein each flank in said second set of teeth has a spacing boss on said flank.

3. A paving stone as in claim 1, wherein said paving stone has a bottom and a height and said indentation keys extend from the bottom to less than the full height of said paving stone.

4. A paving stone as in claim 1, wherein said paving stone has a bottom and a height and said indentation grooves extend from the bottom of said paving stone to less than the full height of said paving stone.

5. A paving stone as in claim 1, wherein said paving stone has a bottom and a height and said spacing bosses extend from the bottom of said paving stone to less than the full height of said paving stone.

6. A paving stone as in claim 1, wherein said teeth on said first and second sides have a top and a chamfered edge is formed between said top and said ends of said teeth in said first and second sets.

7. A paving stone as in claim 1, wherein said paving stone has oppositely positioned right and left ends, wherein said right end has a projection and said left end has a recess which corresponds in shape to said projection.

8. A paving stone as in claim 1, wherein said paving stone has three teeth on each side.

9. A paving stone as in claim 1, wherein said paving stone has oppositely positioned right and left ends, is substantially rectangular in shape and has three teeth on said first and second sides and two teeth on said left and right ends.

10. A paving stone as in claim 1, wherein said paving stone has oppositely positioned left and right ends and said left end is larger than said right end.

11. A paving stone as in claim 1, wherein said paving stone has oppositely positioned left and right ends, is substantially square in shape and has three teeth on its first and second sides, and left and right ends.

12. An assembly of paving stones, wherein each paving stone of said assembly comprises a base with first and second oppositely positioned sides, a first set of tapered outwardly extending teeth on said base's first side, each tooth of said first set being provided with an end distant from said base and an indentation key on said end, and a second set of outwardly extending teeth on said base's second side, each tooth of said second set being provided with an end distant from and two flanks adjacent to said base, with at least one of said flanks having a spacing boss on said flank, and said teeth in said second set having projections on their ends which form an indentation groove corresponding in shape to said indentation keys, wherein said paving stones are combined by engaging said teeth of said first and second sides with teeth of adjoining paving stones.

13. An assembly of paving stones, wherein each paving stone of said assembly comprises a base with first and second oppositely positioned sides, a first set of tapered outwardly extending teeth on said base's first side, each tooth of said first set being provided with an end distant from said base and an indentation key on said end, and a second set of outwardly extending teeth on said base's second side, each tooth of said second set being provided with an end distant from and two flanks adjacent to said base, with at least one of said flanks having a spacing boss on said flank, and said teeth in said second set having projections on their ends which form an indentation groove corresponding in shape to said indentation keys, and said paving stones are combined by engaging said indentation keys with indentation grooves of adjoining paving stones.

14. An assembly of paving stones as in claim 13, wherein filling stones are inserted between flanks of adjoining paving stones.

15. An assembly of paving stones as in claims 12 or 13, wherein said paving stones have different colors.

16. An assembly of paving stones as in claims 12 or 13, wherein said paving stone have different structured surfaces.

17. An assembly of paving stones as in claim 14, wherein said filling stones have a convex surface.

18. A paving stone comprising a base with first and second oppositely positioned sides, a first set of tapered outwardly extending teeth on said base's first side, each tooth of said first set being provided with an end distant from said base and an indentation key on said end, and a second set of outwardly extending teeth on said base's second side, each tooth of said second set being provided with an end distant from and two flanks adjacent to said base, with at least one of said flanks having a spacing boss on said flank, and said teeth in said second set having projections on their ends which form an indentation groove corresponding in shape to said indentation keys, wherein said paving stones have a bottom and a height and said indentation keys, indentation grooves and spacing bosses extend from the bottom of said paving stones to less than their full height.

19. A paving stone comprising a base with first and second oppositely positioned sides, a first set of tapered outwardly extending teeth on said base's first side, each tooth of said first set being provided with a top, an end distant from said base, an indentation key on said end, and a chamfered edge formed between said top and said end, and a second set of outwardly extending teeth on said base's second side, each tooth of said second set being provided with a top and an end distant from and two flanks adjacent to said base, with at least one of said flanks having a spacing boss on said flank, and a chamfered edge formed between said top and said end of said teeth in said second set, and said teeth in said second set having projections on their ends which form indentation grooves corresponding in shape to said indentation keys.

* * * * *